US008692735B2

(12) United States Patent
Kawashimo et al.

(10) Patent No.: US 8,692,735 B2
(45) Date of Patent: Apr. 8, 2014

(54) DISPLAY CONTROL APPARATUS, ELECTRONIC DEVICE, AND COMPUTER PROGRAM PRODUCT

(75) Inventors: Satoshi Kawashimo, Tokyo (JP); Kazuya Fukushima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/404,976

(22) Filed: Feb. 24, 2012

(65) Prior Publication Data

US 2012/0249601 A1 Oct. 4, 2012

(30) Foreign Application Priority Data

Mar. 31, 2011 (JP) ..... 2011-077351

(51) Int. Cl.
*G09G 5/00* (2006.01)

(52) U.S. Cl.
USPC ..... 345/1.1; 345/1.2; 345/1.3

(58) Field of Classification Search
USPC ..... 345/1.1–3.4, 204–215, 418–574, 345/153–179; 382/276–308; 715/234–235, 715/243–253, 273
See application file for complete search history.

(56) References Cited

U.S. PATENT DOCUMENTS

| | | | | |
|---|---|---|---|---|
| 5,467,102 | A * | 11/1995 | Kuno et al. | 345/1.3 |
| 7,868,917 | B2 | 1/2011 | Nakamura | |
| 2010/0188352 | A1* | 7/2010 | Ikeda | 345/173 |
| 2011/0109526 | A1* | 5/2011 | Bauza et al. | 345/1.3 |

FOREIGN PATENT DOCUMENTS

| | | | |
|---|---|---|---|
| JP | H04-248616 | A | 9/1992 |
| JP | H110085116 | A | 3/1999 |
| JP | 2004-272835 | A | 9/2004 |
| JP | 2006-251465 | A | 9/2006 |
| JP | 2006-295723 | A | 10/2006 |
| JP | 2007-142866 | A | 6/2007 |
| JP | 2010-176332 | A | 8/2010 |

OTHER PUBLICATIONS

Notice of Rejection in corresponding Japanese Application No. 2011-077351, mailed May 8, 2012, in 6 pages.

* cited by examiner

*Primary Examiner* — Bipin Shalwala
*Assistant Examiner* — Lisa Landis
(74) *Attorney, Agent, or Firm* — Knobbe, Martens, Olson & Bear, LLP

(57) ABSTRACT

According to one embodiment, a display control apparatus is configured to display a single display image on a plurality of two-dimensionally-arranged display devices combined as a single display device. The display control apparatus includes a display module configured to shift, when a predetermined target image included in the display image is displayed across display screens of the display devices, a display position of the display image so that the target image fits into one of the display screens of the display devices.

6 Claims, 6 Drawing Sheets

DISPLAY CONTROL APPARATUS, ELECTRONIC DEVICE, AND COMPUTER PROGRAM PRODUCT

CROSS-REFERENCE TO RELATED APPLICATIONS

This application is based upon and claims the benefit of priority from Japanese Patent Application No. 2011-077351, filed Mar. 31, 2011, the entire contents of which are incorporated herein by reference.

FIELD

Embodiments described herein relate generally to a display control apparatus, an electronic device, and a computer program product.

BACKGROUND

Typically, there is known a multi-display apparatus for displaying a single image (still image or a moving image) via a plurality of display devices.

Moreover, there is known an image processor which performs image display control with respect to a portion of an image as a target focused for display.

Consider the case of performing image display control with respect to a portion in an image as the target focused for display. In that case, if the image is displayed on a multi-display apparatus and if the target image focused for display (e.g. a human face) appears on a cut line formed between the display screens of displays (i.e., appears on a joint between two displays), then that portion in focus breaks off at that position thereby making it less visible.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment of the invention, a display control apparatus is configured to display a single display image on a plurality of two-dimensionally-arranged display devices functioning together as a single display device. The display control apparatus comprises a display module that, when a predetermined image portion in focus that is included in the display image is displayed across display screens of more than one of the display devices, shifts a display position of the display image in such a way that the image portion in focus is displayed entirely on the display screen of one of the display devices.

The detailed description of embodiments of the invention is given below with reference to the accompanying drawings.

Figure 1A:
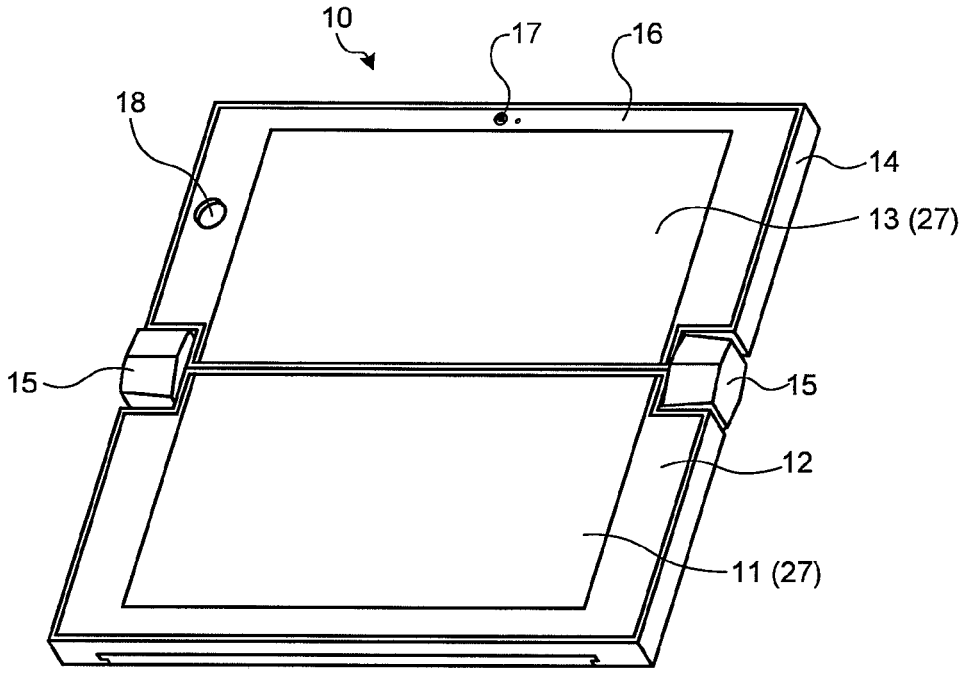
FIGS. 1A and 1B are exemplary external views of an electronic device according to a first embodiment.
Figure 1B:
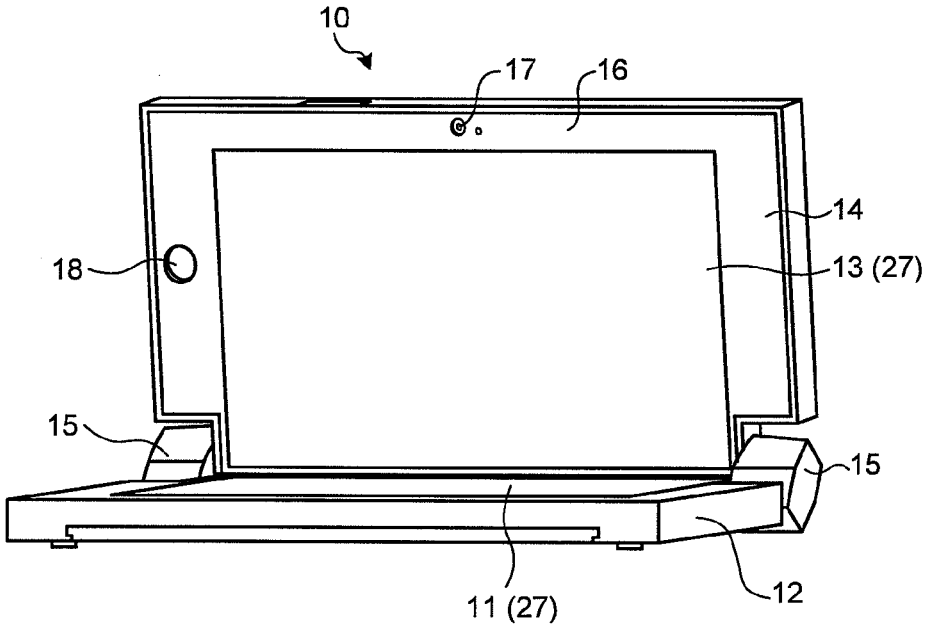

FIGS. 1A and 1B are external views of an electronic device according to a first embodiment.

FIG. 1A is an external perspective view of an open state in which the electronic device is opened in 180°. FIG. 1B is an external perspective view of a folded state when the electronic device is folded through midway similar to a notebook-sized personal computer.

Herein, an electronic device 10 is a foldable and portable electronic device such as a mobile personal computer, a gaming console, or an electronic book reader.

The electronic device 10 comprises: a first housing 12 in which is housed a first display 11; a second housing 14 in which is housed a second display 13; and a hinge 15 for supporting the first housing 12 and the second housing 14 in a relatively rotatable manner.

The second housing 14 has a bezel 16, on which a camera module 17 is embedded and a power switch 18 is installed.

Figure 2:
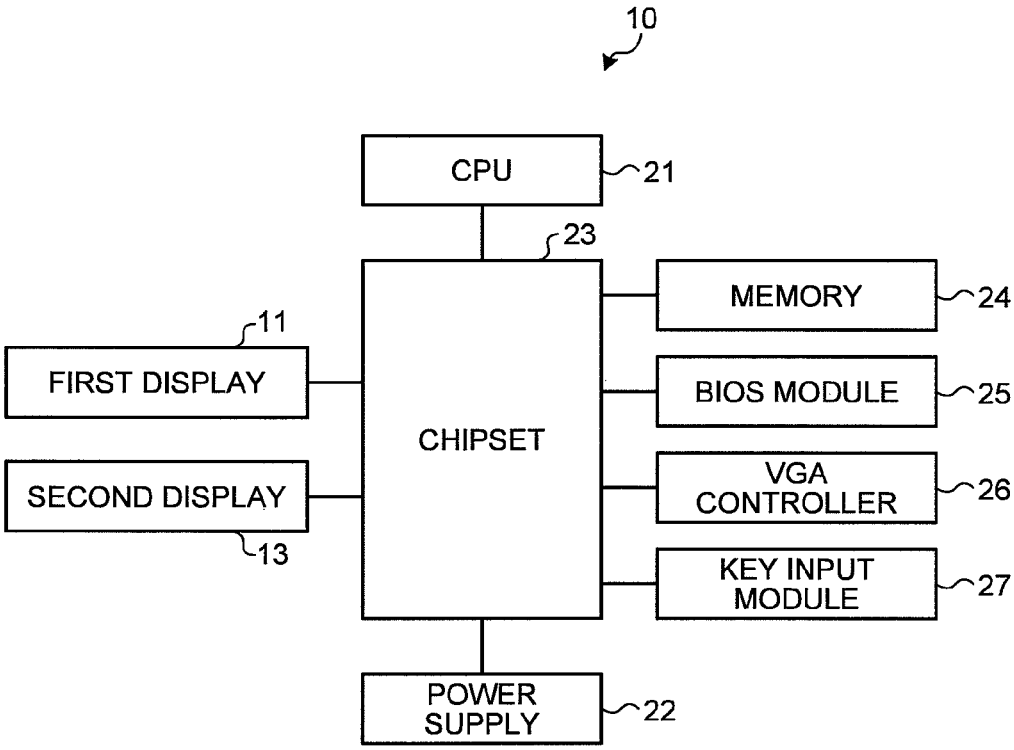
FIG. 2 is an exemplary block diagram of a general configuration of the electronic device in the first embodiment.

FIG. 2 is a block diagram of a general configuration of the electronic device.

Apart from the first display 11 and the second display 13, the electronic device 10 also comprises: a central processing unit (CPU) 21 controlling the electronic device 10 in entirety; a power supply 22 comprising a rechargeable battery and supplying electrical power to the entire electronic device 10; a chipset 23 performing interface operations and timing adjustment operations between the CPU 21 and peripheral devices; a memory 24 comprising a read only memory (ROM) storing therein control programs, a random access memory (RAM) storing therein a variety of data on a temporary basis and serving as a work area, and a nonvolatile random access memory (NVRAM) storing therein a variety of data in a nonvolatile manner; a basic input/output system (BIOS) module 25 performing various operations at the time of booting the electronic device 10; a video graphics array (VGA) controller 26 performing screen display control for the first display 11 and the second display 13; and a key input module 27 that constitutes a touch-sensitive panel display in an integrated manner with the first display 11 and the second display 13.

Figure 3A:
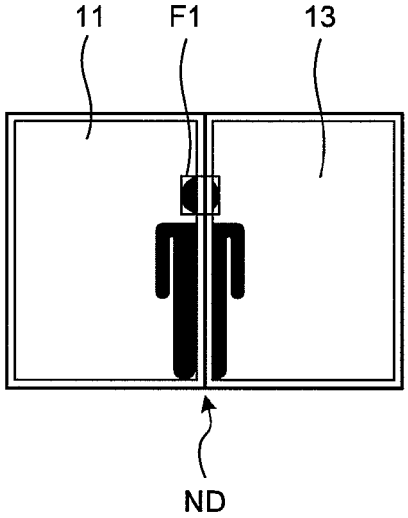
FIGS. 3A and 3B are exemplary explanatory diagrams of operations in the first embodiment.
Figure 3B:
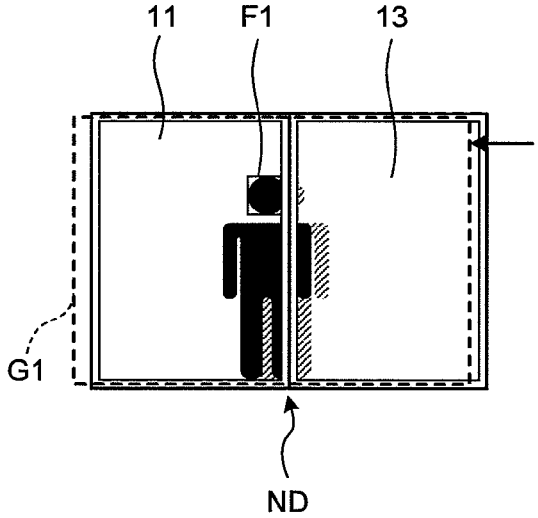

FIGS. 3A and 3B are explanatory diagrams operations according to the first embodiment.

Figure 4:
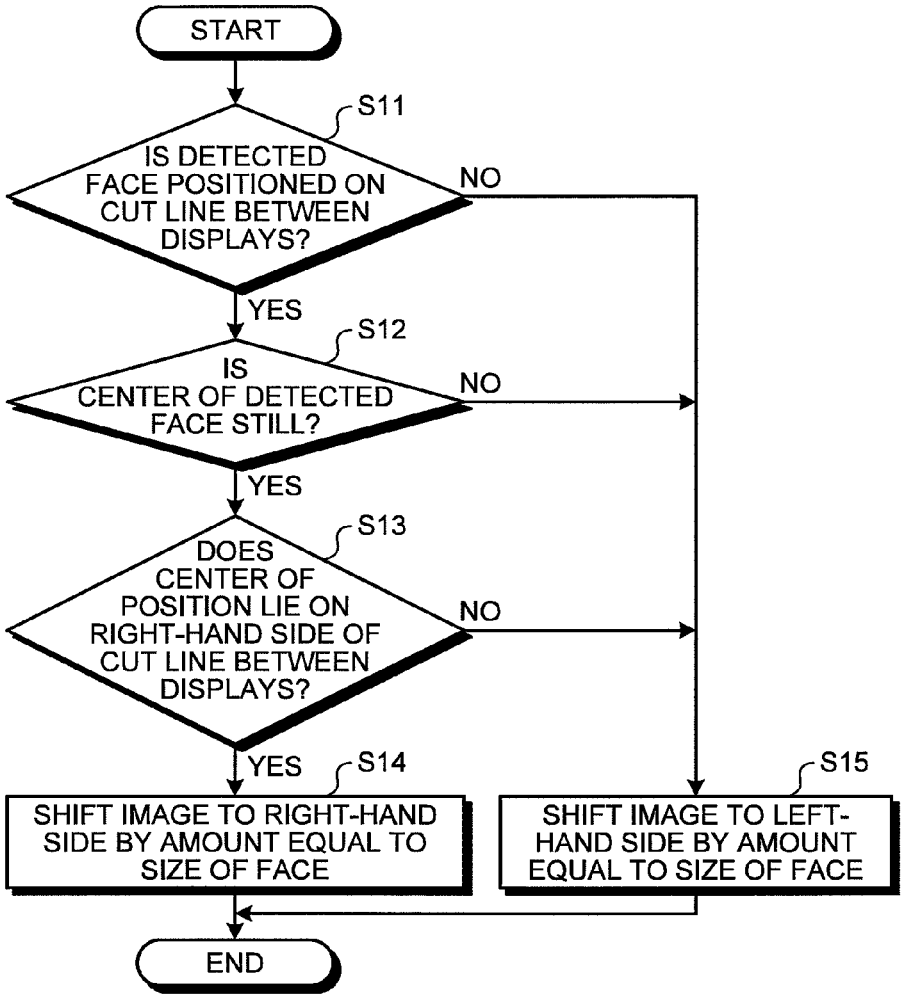
FIG. 4 is an exemplary flowchart of an image processing in the first embodiment.

FIG. 4 is a flowchart of an image processing according to the first embodiment.

Firstly, the CPU 21 detects the center position and the dimensions of a face image F1 (in the first embodiment, the image portion within a rectangular region presumed to contain a face; image portion in focus) of a person appearing in a target image for display, and determines whether the detected face image (face) is positioned on a cut line ND formed between the two display regions of the first display 11 and the second display 13 (S11).

In FIGS. 3A and 3B, the cut line ND formed between the display regions of the two displays represents a section between the first display 11 and the second display 13, and corresponds to a deficient portion of a single image displayed on the first display 11 and the second display 13 cooperatively combined as a single display (corresponds to a so-called bezel portion of commonly-used display). That is because, in the first embodiment, while displaying an image on the first display 11 and the second display 13, it is assumed that a physically-distant section between the first display 11 and the second display 13 can also display the image.

Thus, for example, the display control is performed in such a manner that, in a case of displaying a horizontally long rod on a display screen of either one of the first display 11 and the second display 13 so as to fit within the display screen and in a case of displaying the same horizontally long rod across display screens of both the first display 11 and the second display 13, the visual lengths of that rod are almost identical in both cases. Hence, even if the horizontally long rod displayed on the first display 11 positioned on the left-hand side with respect to the user is moved toward the right and displayed on the second display 13 positioned on the right-hand side with respect to the user, it is ensured that the user does not feel any difference in the length of the rod while being moved.

Meanwhile, at S11, if the face image F1 of a person is not detected to be positioned on the cut line ND formed between the display regions of the two displays (No at S11), the CPU 21 terminates the image processing.

However, at S11, if the face image F1 of a person is detected to be positioned on the cut line ND formed between the display regions of the two displays (Yes at S11), the CPU 21 determines whether the amount of movement at the center position of the face image F1 being displayed is equal to or smaller than a predetermined amount, that is, whether the face image F1 can be considered to be still (S12).

If the face image F1 cannot be considered to be still, then it is likely that the face image F1 would shortly move away from the cut line ND. Hence, by unnecessarily performing the image processing at that stage, there is a possibility that the face image F1 ends up positioned on the cut line ND.

Thus, when the face image F1 cannot be considered to be still (No at S12), the CPU 21 terminates the image processing.

On the other hand, when the face image F1 can be considered to be still (Yes at S12), the CPU 21 determines whether the center position of the face image F1 lies on the first display 11 or on the second display 13 (S13). Herein, the flowchart illustrated in FIG. 4 is given under the assumption that, under normal use, the electronic device 10 comprises a pair of displays (in the first embodiment, the first display 11 and the second display 13) and that the CPU 21 determines whether the center position of the face image F1 is detected to be positioned on the right-hand side of the displays (i.e., detected to be positioned on the right-hand side display).

If the center position of the face image F1 is detected to be positioned on the left-hand side of the cut line ND (i.e., detected to be positioned on the first display 11 located on the left-hand side) as illustrated in FIG. 3A (No at S13), then, as illustrated in FIG. 3B, the CPU 21 shifts an image G1 to the left-hand side by an amount equal to the size of the face image F1 (in FIGS. 3A and 3B, the horizontal width of the face image F1), so that the face image F1 is displayed to entirely fit within the first display 11 (S15). Meanwhile, instead of shifting the image by only the amount equal to the size of the face image F1, a margin of $\alpha$ (where $\alpha>0$) can be allowed so that the image is shifted by an amount equal to the size of the face image F1+$\alpha$.

If the center position of the face image F1 is detected to be positioned on the right-hand side of the cut line ND (i.e., detected to be positioned on the second display 13 located on the right-hand side) (Yes at S13), then the CPU 21 shifts the image G1 to the right-hand side by an amount equal to the size of the face image F1, so that the face image F1 is displayed to entirely fit within the second display 13 (S14). Even in this case, instead of shifting the image by only the amount equal to the size of the face image F1, a margin of $\alpha$ (where $\alpha>0$) can be allowed so that the image is shifted by an amount equal to the size of the face image F1+$\alpha$.

As described above, according to the first embodiment, even when the face image of a photographic subject in an image is positioned on the cut line formed between the display regions of two displays, the image is shifted in such a way that the face image is displayed so as to fit in either one of the two displays. Thus, the viewability of the image portion that the user likely intends to view can be improved, and further, the viewability of the entire image can also be improved.

Herein, the explanation is given for the case in which an image is so shifted that the face image is displayed so as to entirely fit in either one of the displays. However, in case of having an image portion such as a close-up face image, it is not possible to display the image portion only on a single display such as to fit in the single display, even by shifting the image up to the end of the display. In such a case, it may be an option not to shift the image at all. Alternatively, a maximum allowable shift amount can be set in advance and it can be determined not to shift the image if the expected shift amount exceeds the maximum allowable shift amount.

Given below is the explanation of a second embodiment. In the first embodiment, the explanation is given for the case in which a single person (single face image) is present in an image displayed on the display screens. In contrast, in the second embodiment, the explanation is given for a case when more than one person (more than one face image) are present close to each other in an image.

Figure 5A:
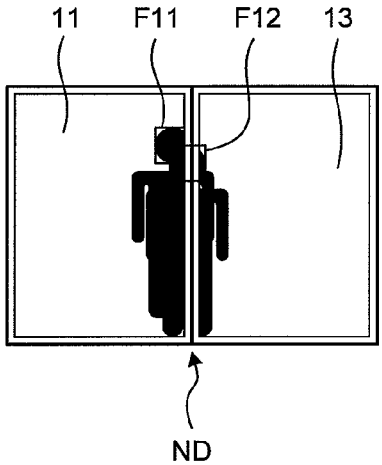
FIGS. 5A and 5B are exemplary explanatory diagrams of operations according to a second embodiment.
Figure 5B:
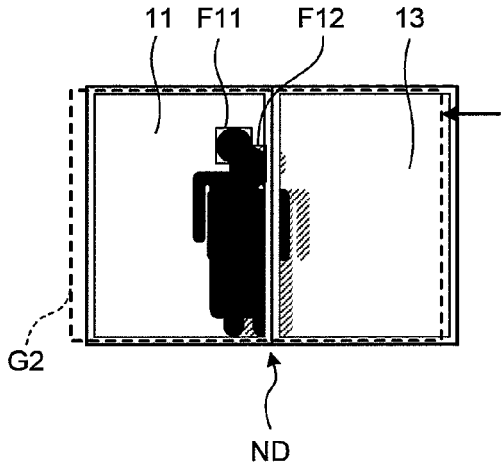

FIGS. 5A and 5B are explanatory diagrams for explaining the operations performed according to the second embodiment.

Figure 6:
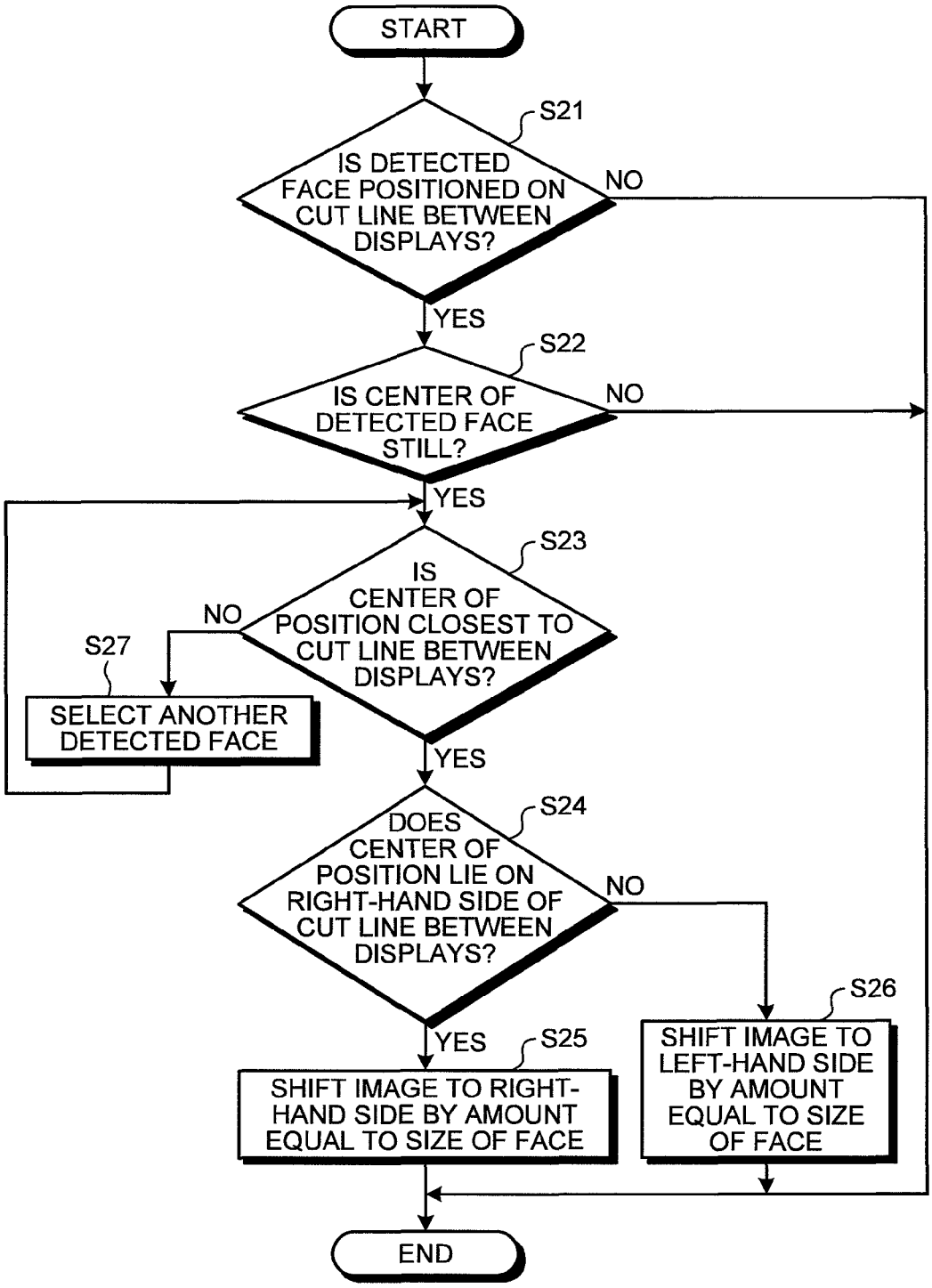
FIG. 6 is an exemplary flowchart of an image processing in the second embodiment.

FIG. 6 is a flowchart of an image processing according to the second embodiment.

Firstly, the CPU 21 detects a center position and a dimension of each of face images F11 and F12 of the people appearing in the target image for display.

Then, the CPU 21 determines whether at least one of the face image F11 and the face image F12 is positioned on the cut line ND formed between the two displays regions of the first display 11 and the second display 13 (S21).

If none of the face images F11 and F12 is detected to be positioned on the cut line ND formed between the display regions of the two displays (No at S21), the CPU 21 terminates the image processing.

On the other hand, if at least one of the face images F11 and F12 is detected to be positioned on the cut line ND formed between the display regions of the two displays (Yes at S21), the CPU 21 determines whether the amount of movement of the center position of the at least one of the face image F11 and the face image F12 positioned on the cut line ND is equal to or smaller than a predetermined amount, that is, whether the at least one of the face image F11 and the face image F12 can be considered to be still (S22).

If the at least one of the face image F11 and the face image F12 positioned on the cut line ND cannot be considered to be still, then it is likely that the at least one of the face image F11 and the face image F12 would shortly move away from the cut line ND. Hence, by unnecessarily performing the image processing at that stage, there is a possibility that the at least one of the face image F11 and the face image F12 end up positioned on the cut line ND.

Thus, when the at least one of the face image F11 and the face image F12 positioned on the cut line ND cannot be considered to be still (No at S22), the CPU 21 terminates the image processing.

On the other hand, when the at least one of the face image F11 and the face image F12 positioned on the cut line ND can be considered to be still (Yes at S22), the CPU 21 selects one of the face images F11 and F12 positioned on the cut line ND, and determines whether the center position of the selected face image is positioned closest to the cut line ND formed between the two displays (S23).

If the center position of the selected face image is not closest to the cut line ND formed between the two displays (No at S23), the CPU 21 selects other one of the face images F11 and F12 positioned on the cut line ND (S27) and the system control returns to S23.

For example, in the example illustrated in FIGS. 5A and 5B, assume that the face image F11 is selected from the face images F11 and F12 positioned on the cut line ND formed between the two display regions. However, since the center position of the face image F11 is not the closest position to the cut line ND, the other face image F12 that is also positioned on the cut line ND is selected.

Meanwhile, if the center position of the selected face image positioned closest to the cut line ND formed between the two displays (Yes at S23), the system control proceeds to S24.

For example, in the example illustrated in FIGS. 5A and 5B, assume that the face image F12 is selected from the face images F11 and F12 positioned on the cut line ND formed between the two display regions. In that case, since the center position of the face image F12 is position the closest to the cut line ND, the system control proceeds to S24.

Then, the CPU 21 determines whether the center position of the detected face image (in the second embodiment, the face image F12) is positioned on the first display 11 or on the second display 13 (S24). Herein, the flowchart illustrated in FIG. 6 is given under the assumption that, under normal use, the electronic device 10 comprises a pair of displays (in the second embodiment, the first display 11 and the second display 13) and that the CPU 21 determines whether the center position of the face image F12 is detected to be positioned on the right-hand side of the displays (i.e., detected to be positioned on the right-hand side display).

If the center position of the face image F12 is detected to be positioned on the left-hand side of the cut line ND (i.e., detected to be positioned on the first display 11 located on the left-hand side) as illustrated in FIG. 5A (No at S24), then as illustrated in FIG. 5B, the CPU 21 shifts an image G2 to the left-hand side by an amount equal to the size of the face image F12 (in FIGS. 5A and 5B, the horizontal width of the face image F12), so that the face image F12 is displayed to entirely fit within the first display 11 (S26). Meanwhile, instead of shifting the image by only the amount equal to the size of the face image F12, a margin of $\alpha$ (where $\alpha>0$) can be allowed so that the image is shifted by an amount equal to the size of the face image F12+$\alpha$.

If the center position of the face image F12 is detected to be positioned on the right-hand side of the cut line ND (i.e., detected to be positioned on the second display 13 located on the right-hand side) (Yes at S24), then the CPU 21 shifts the image G2 to the right-hand side by an amount equal to the size of the face image F12, so that the face image F12 is displayed to entirely fit within the second display 13 (S25). Even in this case, instead of shifting the image by only the amount equal to the size of the face image F12, a margin of $\alpha$ (where $\alpha>0$) can be allowed so that the image is shifted by an amount equal to the size of the face image F12+$\alpha$.

As described above, according to the second embodiment, even when the face images of a plurality of photographic subjects in an image are positioned on the cut line formed between the display regions of two displays, the image is shifted in such a way that each face image is displayed so as to entirely fit within either one of the two displays. Therefore, the viewability of the image portion that the user likely intends to view is improved, and further, the viewability of the entire image is also improved.

Herein, the explanation is given for the case in which an image is so shifted that each face image is displayed to entirely fit within either one of the displays. However, in the case of an image portion such as a close-up face image or when more than one face image is present, it may not be possible to display all image portions to fit within only a single display even by shifting the image up to the end of the display. In such a case, it may be an option to not shift the image at all. Alternatively, a maximum allowable shift amount can be set in advance and it can be determined not to shift the image if the expected shift amount exceeds the maximum allowable shift amount.

Given below is the explanation of a third embodiment.

In the first and second embodiments, the explanation is given for the case in which face images in the display screens are shifted to the left-hand side or to the right-hand side so as to avoid the cut line ND while displaying the face images. In the third embodiment, the explanation is given for a case when, in an attempt to avoid the cut line ND while displaying a particular face image, some other face image ends up positioned on the cut line ND.

Figure 7A:
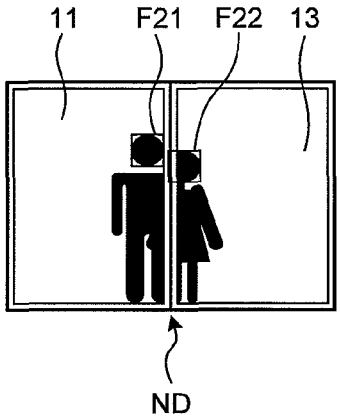
FIGS. 7A to 7C are exemplary explanatory diagrams of operations according to a third embodiment.
Figure 7B:
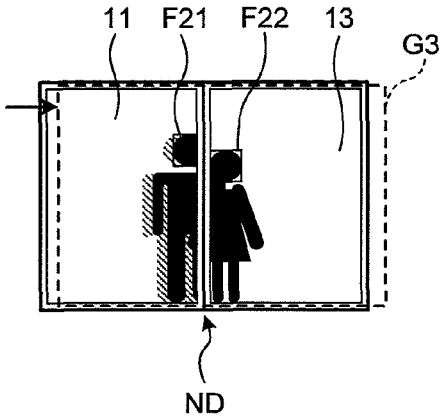
Figure 7C:
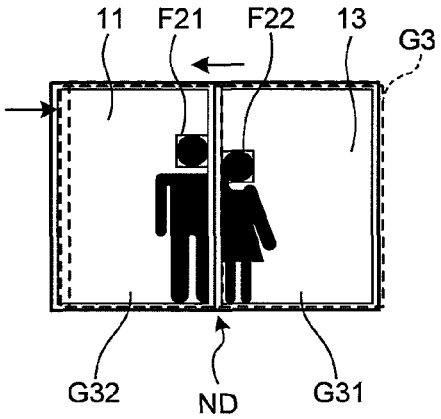

FIGS. 7A to 7C are explanatory diagrams of operations according to the third embodiment.

Figure 8:
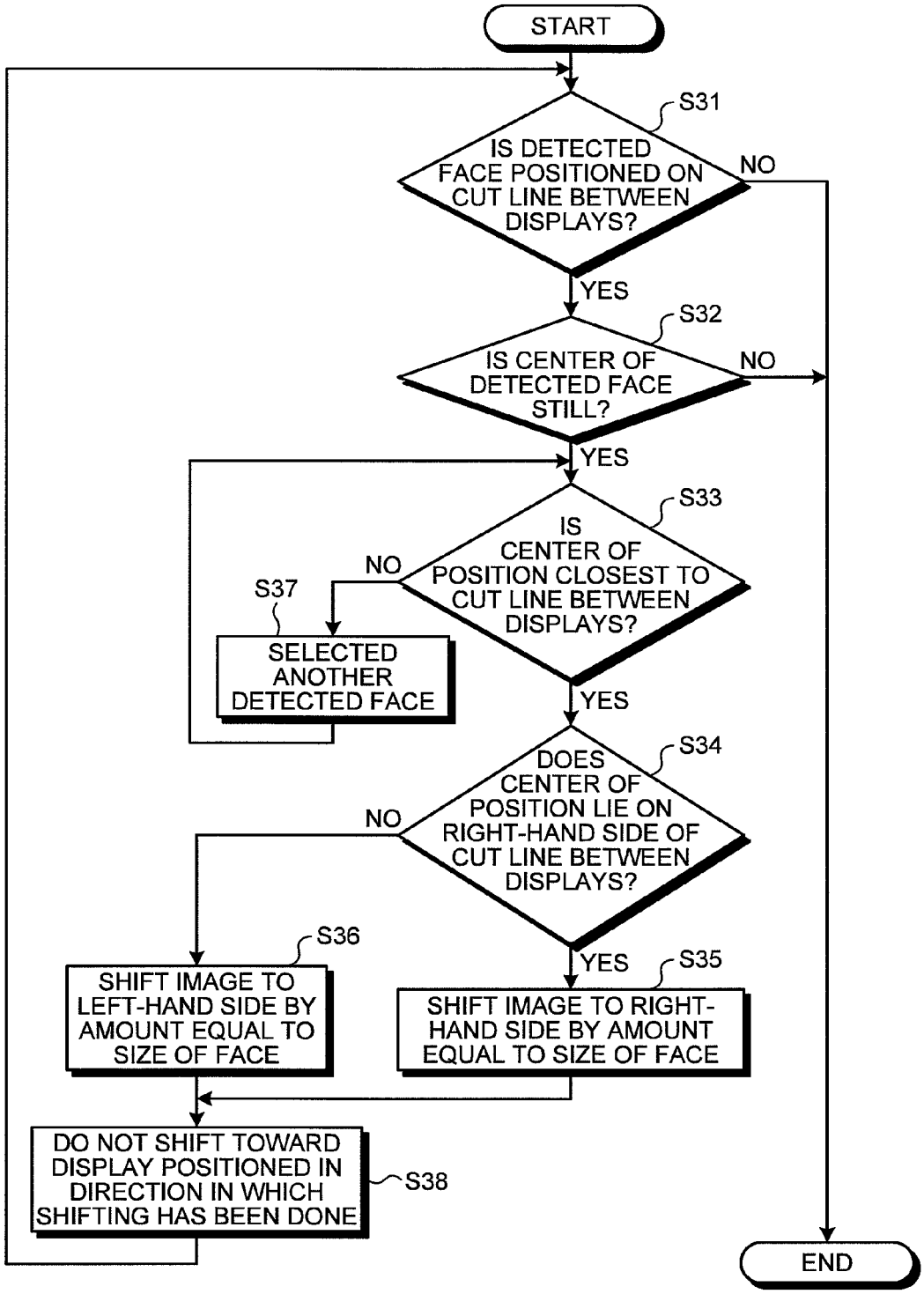
FIG. 8 is an exemplary flowchart of an image processing in the third embodiment.

FIG. 8 is a flowchart of an image processing according to the third embodiment.

Firstly, the CPU 21 detects a center position and a dimension of each of face images F21 and F22 of the people appearing in the target image for display.

Then, the CPU 21 determines whether at least one of the face image F21 and the face image F22 are positioned on the cut line ND formed between the two displays regions of the first display 11 and the second display 13 (S31).

If none of the face images F21 and F22 is detected to be positioned on the cut line ND formed between the display regions of the two displays (No at S31), the CPU 21 terminates the image processing.

On the other hand, if at least one of the face images F21 and F22 is detected to be positioned on the cut line ND formed between the display regions of the two displays (Yes at S31), the CPU 21 determines whether the amount of movement at the center position of the at least one of the face image F21 and the face image F22 positioned on the cut line ND is equal to or smaller than a predetermined amount, that is, whether the at least one of the face image F21 and the face image F22 can be considered to be still (S32).

If the at least one of the face image F21 and the face image F22 positioned on the cut line ND cannot be considered to be still, then it is possible to believe that the at least one of the face image F21 and the face image F22 would shortly move away from the cut line ND. Hence, by unnecessarily performing the image processing at that stage, there is a possibility that the at least one of the face image F21 and the face image F22 ends up positioned on the cut line ND.

Thus, when the at least one of the face image F21 and the face image F22 positioned on the cut line ND cannot be considered to be still (No at S32), the CPU 21 terminates the image processing.

On the other hand, when the at least one of the face image F21 and the face image F22 positioned on the cut line ND can be considered to be still (Yes at S32), the CPU 21 selects one of the face images F21 and F22 positioned on the cut line ND and determines whether the center position of that face image is positioned closest to the cut line ND formed between the two displays (S33).

If the center position of the selected face image is not closest to the cut line ND formed between the two displays (No at S33), the CPU 21 selects other one of the face images F21 and F22 positioned on the cut line ND (S37), and the system control returns to S33.

For example, in the example illustrated in FIGS. 7A to 7C, assume that the face image F21 is selected from the face images F21 and F22 positioned on the cut line ND formed between the two display regions. However, since the center position of the face image F21 is not closest to the cut line ND, the other face image F22 that is also positioned on the cut line ND is selected.

On the other hand, in the determination at S33, if one of the face images positioned on the cut line ND formed between the two displays is selected and the center position of the selected face image is positioned closest to the cut line ND formed between the two displays (Yes at S33), the system control proceeds to S34.

For example, in the example illustrated in FIGS. 7A to 7C, assume that the face image F22 is selected from the face images F21 and F22 positioned on the cut line ND formed between the two display regions. In that case, since the center position of the face image F22 lies closest to the cut line ND, the system control proceeds to S34.

Then, the CPU 21 determines whether the center position of the detected face image (in the third embodiment, the face image F22) is positioned on the first display 11 or on the second display 13 (S34). Herein, the flowchart illustrated in FIG. 8 is given under the assumption that, under normal use, the electronic device 10 comprises a pair of displays (in the third embodiment, the first display 11 and the second display 13) and that the CPU 21 determines whether the center position of the face image F22 is detected to be positioned on the right-hand side of the displays (i.e., detected to be positioned on the right-hand side display).

If the center position of the face image F22 is detected to be positioned on the right-hand side of the cut line ND (i.e., detected to be positioned on the second display 13 located on the right-hand side) as illustrated in FIG. 7A (Yes at S34), then as illustrated in FIG. 7B, the CPU 21 shifts an image G3 to the right-hand side by an amount equal to the size of the face image F22 (in FIGS. 7A to 7C, the horizontal width of the face image F22), so that the face image F22 is displayed to entirely fit within the second display 13 (S35). Meanwhile, instead of shifting the image by only the amount equal to the size of the face image F22, a margin of $\alpha$ (where $\alpha>0$) can be allowed so that the image is shifted by an amount equal to the size of the face image F22+$\alpha$.

Subsequently, with respect to an image displayed on one of the displays toward which the image is shifted (in the present example, the second display 13), the CPU 21 fixes the position of the image and makes it non-shiftable (S38), and the system control returns to S31.

Then, the CPU 21 determines whether the other face image F21 is positioned on the cut line ND formed between the two displays regions of the first display 11 and the second display 13 (S31).

If no face image is detected to be positioned on the cut line ND formed between the display regions of the two displays, that is, if the face image F21 is not detected to be positioned on the cut line ND (No at S31), then the CPU 21 terminates the image processing.

On the other hand, if the face image F21 is detected to be positioned on the cut line ND formed between the display regions of the two displays (Yes at S31), the CPU 21 determines whether the amount of movement at the center position of the face image F21 positioned on the cut line ND is equal to or smaller than a predetermined amount, that is, whether the face image F21 can be considered to be still (S32).

If the face image F21 positioned on the cut line ND cannot be considered to be still (No at S32), the CPU 21 terminates the image processing.

On the other hand, when the face image F21 positioned on the cut line ND can be considered to be still (Yes at S32), the CPU 21 selects the face image F21 positioned on the cut line ND and determines whether the center position of that face image is positioned closest to the cut line ND formed between the two displays (S33).

In the example illustrated in FIG. 7B, since the center position of the face image F21 is positioned closest to the cut line ND, the system control proceeds to S34.

Then, the CPU 21 determines whether the center position of the detected face image (in the third embodiment, the face image F21) is positioned on the first display 11 or on the second display 13 (S34).

If the center position of the face image F21 is detected to be positioned on the left-hand side of the cut line ND (i.e., detected to be positioned on the first display 11 located on the left-hand side) as illustrated in FIG. 7B (No at S34), then as illustrated in FIG. 7C, among sections of the image G3 shifted toward the right-hand side by the size of the face image F22 (in FIG. 7, it is the horizontal width of the face image F22), the CPU 21 displays an image section G31 displayed on the second display 13 on the right-hand side in a way as similar to before. On the other hand, the CPU 21 displays an image section G32 corresponding to an image, which is one of the image sections of the image G3, displayed on the first display 11 on the left-hand side, and is shifted toward the left-hand side, so as to display the entire face image F21 on the first display 11 (S36).

Meanwhile, instead of shifting the image by only the amount equal to the size of the face image F21, a margin of $\alpha$ (where $\alpha>0$) can be allowed so that the image is shifted by an amount equal to the size of the face image F21+$\alpha$.

Subsequently, on that display toward which image shifting has been done (in the present example, the first display 11), the CPU 21 fixes the position of the image and makes it non-shiftable (S38), and the system control returns to S31. Thereafter, the abovementioned operations are repeated.

As described above, according to the third embodiment, when the face images of a plurality of photographic subjects in an image are positioned on the cut line formed between the display regions of two displays, overlapping of face images occurs in the vicinity of the cut line ND formed between the two displays. However, the images are shifted in such a way that each of the face images F21 and F22 is shifted to an easily viewable position on either one of the two displays. Therefore, the viewability of the image portion that the user likely intends to view can be improved. By extension, the viewability of the entire image can also be improved.

In the above, the explanation is given for the case in which an image is so shifted that each face image is displayed to entirely fit within either one of the displays. However, in the case of an image portion such as a close-up face image or when more than one face image is present, it may not be possible to entirely display all image portions on only a single display even by shifting the image up to the end of the display. In such a case, it may be an option not to shift the image at all. Alternatively, a maximum allowable shift amount can be set in advance and it can be determined not to shift the image if the expected shift amount exceeds the maximum allowable shift amount.

As described above, regarding the important portions (in the embodiments described above, the face images) of photographic subjects that the user intends to view, each such portion can be displayed to entirely fit within the screen of one of a plurality of displays. Therefore, the viewability of the screen can be improved.

In the explanation given above, although it is assumed that a single electronic device comprises a plurality of display devices, it is also possible to configure a plurality of display devices as separate display control apparatuses.

Moreover, in the explanation given above, although the target portions for display are considered to be the face images of people, the explanation can also be applied to any type of independently-identifiable target portion. For example, it is possible to take into consideration image portions containing cars, image portions containing pets, or face images of pets as the target portions for display.

Besides, a target portion for display is not limited to the face image of a person, and can be the total individual.

Meanwhile, in the explanation given above, although the electronic device is assumed to comprise two displays, the explanation is also applicable to an electronic device comprising three or more displays.

Moreover, control programs executed in the electronic device according to the embodiments can be provided in the form of an installable or executable file on a computer-readable recording medium such as a compact disk read only memory (CD-ROM), a flexible disk (FD), a compact disk readable (CD-R), or a digital versatile disk (DVD).

Alternatively, the control programs executed in the electronic device according to the embodiments can be saved as a downloadable file on a computer connected to the Internet or can be made available for distribution through a network such as the Internet. Still alternatively, the control programs executed in the electronic device according to the embodiments can be distributed over a network such as the Internet.

Still alternatively, the control programs executed in the electronic device according to the embodiments can be stored in advance in a ROM or the like.

Moreover, the various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display control apparatus configured to display a single display image over display screens of a plurality of display devices, the display devices having the display screens, respectively, the display image having a region corresponding to all region of the display screens, the apparatus comprising:

a display module configured to shift, when the display image is arranged at a predetermined position to be displayed and each of first target images in the display image is across the display screens of the display devices, a display position of the display image toward one of the display screens of the display devices which displays more a second target image positioned closest to a cut line between display regions of the first target images so that the second target image fits into the display screen, wherein prior to when the second target image is shifted, when the display position of the display image is shifted toward the one of the display screens of the display devices which displays more the second target image that is in a first direction and third target image other than the second target image of the first target images is newly displayed across the display screens of the display devices, the display module is configured to shift in a second direction a display position of a display image displayed on another one of the display devices positioned in the second direction with respect to a cut lines of the displayed third target image of the image shifted in the first direction, the second direction being opposite to the first direction.

2. The display control apparatus of claim 1, wherein when the first target images are displayed across the display screens of the display devices, the display module is configured to shift the display position of the display image toward one of the display screens of the display devices which displays more the second target image positioned closest to the cut line between the display regions of the first target images that is in a first direction, and to shift in a second direction a display position of a display image displayed on another one of the display devices positioned in the second direction of the image shifted in the first direction, the second direction being opposite to the first direction when a third target image other than the second target image of the first target images is still displayed across the display screens of the display devices.

3. The display control apparatus of claim 1, wherein the first target image is a rectangular image, and the display control apparatus is configured to set a shift amount of the first target image displayed on the display devices.

4. The display control apparatus of claim 1, wherein the first target image is a face image of a person.

5. An electronic device comprising:

a display device configured to display a single display image over display screens of a plurality of display units, the display units having the display screens, respectively, the display image having a region corresponding to all region of the display screens; and a display module configured to shift, when the display image is arranged at a predetermined position to be displayed and each of first target images in the display image is across the display screens of the display units, a display position of the display image toward one of the display screens of the display units which displays more a second target image positioned closest to a cut line between display regions of the first target images so that the second target image fits into the display screen of one of the display units, wherein prior to when the second target image is shifted, when the display position of the display image is shifted toward the one of the display screens of the display devices which displays more the second target image that is in a first direction and third target image other than the second target image of the first target images is newly displayed across the display screens of the display devices, the display module is configured to shift in a second direction a display position of a display image displayed on another one of the display devices positioned in the second direction with respect to a cut lines of the displayed third target image of the image shifted in the first direction, the second direction being opposite to the first direction.

6. A computer program product having a non-transitory computer readable medium including programmed instructions, wherein the instructions, when executed by a computer, cause the computer to control a display control apparatus configured to display a single display image over display screens of a plurality of display units, the display units having the display screens, respectively, the display image having a region corresponding to all region of the display screens, and cause the computer to perform:

determining whether each of first target images in the display image is across display screens of the display units when the display image is arranged at a predetermined position to be displayed; and when each of the first target images in the display image is across the display screens of the display units, shifting a display position of the display image toward one of the display screens of the display devices which displays more a second target image positioned closest to a cut line between display regions of the first target images so that the second target image fits into the display screen of one of the display units, wherein prior to when the second target image is shifted, when the display position of the display image is shifted toward the one of the display screens of the display devices which displays more the second target image that is in a first direction and third target image other than the second target image of the first target images is newly displayed across the display screens of the display devices, shifting in a second direction a display position of a display image displayed on another one of the display devices positioned in the second direction with respect to a cut lines of the displayed third target image of the image shifted in the first direction, the second direction being opposite to the first direction.

* * * * *